United States Patent [19]

Norberg

[11] Patent Number: 4,700,530

[45] Date of Patent: Oct. 20, 1987

[54] METHOD AND DEVICE FOR PLACING EDGE PROTECTING MEANS AT PRESSURE-SENSITIVE EDGES ON OBJECTS

[75] Inventor: Helmer L. Norberg, Sundsbruk, Sweden

[73] Assignee: Dendro Maskin DM AB, Stockholm, Sweden

[21] Appl. No.: 834,268

[22] PCT Filed: Jun. 3, 1985

[86] PCT No.: PCT/SE85/00232

§ 371 Date: Feb. 4, 1986

§ 102(e) Date: Feb. 4, 1986

[87] PCT Pub. No.: WO86/00057

PCT Pub. Date: Jan. 3, 1986

[30] Foreign Application Priority Data

Jun. 13, 1984 [SE] Sweden ..... 8403172

[51] Int. Cl.[4] ..... B65B 13/06; B65B 13/18

[52] U.S. Cl. ..... 53/410; 53/128; 53/399; 53/582; 83/231; 83/233; 83/277; 221/71; 226/151; 226/167

[58] Field of Search ..... 53/128, 389, 397, 399, 53/410, 580, 582; 221/71; 226/151, 147, 167; 83/222, 231, 232, 233, 277; 493/89, 356, 357, 455

[56] References Cited

U.S. PATENT DOCUMENTS

| | | | |
|---|---|---|---|
| 1,988,814 | 1/1935 | Silby | 493/89 |
| 2,811,086 | 10/1957 | Hollis | 493/89 |
| 2,860,703 | 11/1958 | O'Donnell | 83/231 |
| 3,003,296 | 10/1961 | Feldkamp et al. | 53/410 |
| 3,271,925 | 9/1966 | Aubery | 53/128 |
| 3,585,780 | 6/1971 | Elmore | 53/128 |
| 4,306,477 | 12/1981 | Travis | 83/277 |
| 4,587,791 | 5/1986 | Brouse et al. | 53/128 |

FOREIGN PATENT DOCUMENTS 354457 3/1973 Sweden .

*Primary Examiner*—Robert L. Spruill
*Assistant Examiner*—Donald R. Studebaker
*Attorney, Agent, or Firm*—Young & Thompson

[57] ABSTRACT

A method and a device for placing edge protecting means (7) at objects in connection with band strapping. The inventive method is distinguished in that blanks for edge protecting means (7) are fed as a continuous band (7*a*) which when advanced is preliminary bent around a longitudinal line, that the fed-out portion of the band (7*a*) is cut to form an edge protecting means (7) in correct position, and that the edge protecting means (7) is finally bent in connection with cutting. The inventive device is characterized in that a magazine containing blanks for edge protecting means in the form of a band (7*a*) is secured to a body (6) supporting a feeding mechanism (8–17) for said band which comprises means (8) for preliminary bending the band (7*a*) around a longitudinal line, a cutting means (30) being fixed to the body (6) serving to separate, after feeding the band a predetermined distance, the fed-out portion of the band as an edge protecting means (7), a bending means (30, 32) thereby being arranged to finally bend the edge protecting means (7) on separation thereof.

9 Claims, 5 Drawing Figures

METHOD AND DEVICE FOR PLACING EDGE PROTECTING MEANS AT PRESSURE-SENSITIVE EDGES ON OBJECTS

BACKGROUND OF THE INVENTION

The invention relates to a method and a device for placing edge protecting means at pressure-sensitive edges on objects, preferably in connection with packaging said objects by means of band strapping.

When packaging objects by means of band strapping it is common practice, in order to preserve the edges of objects, to insert edge protecting means underneath the bands. This technique is employed within a plurality of various fields, for example in the wood industry for lumber packaging. In the past, ready-made edge protecting means were applied under the bands prior to tightening. When tightening, however, the bands will move irregularly making it diffucult to retain the edge protecting means in their proper position underneath the bands. As a consequence, the edge protecting means have often been misplaced, and therefore do more harm than good.

SUMMARY OF THE INVENTION

The object of the invention is to eliminate the above-mentioned disadvantages and to achieve a method and a device for the application of edge protecting means, enabling in a simple manner the edge protecting means to be correctly positioned without the risk of being displaced when tightening the bands during packaging. In accordance with the invention, this is accomplished with a method and a device having the characterizing features set forth in the attached claims.

BRIEF DESCRIPTION OF THE DRAWINGS

The invention will be described in more detail below while referring to the accompanying drawings, of which.

DETAILED DESCRIPTION OF THE INVENTION

Figure 1:
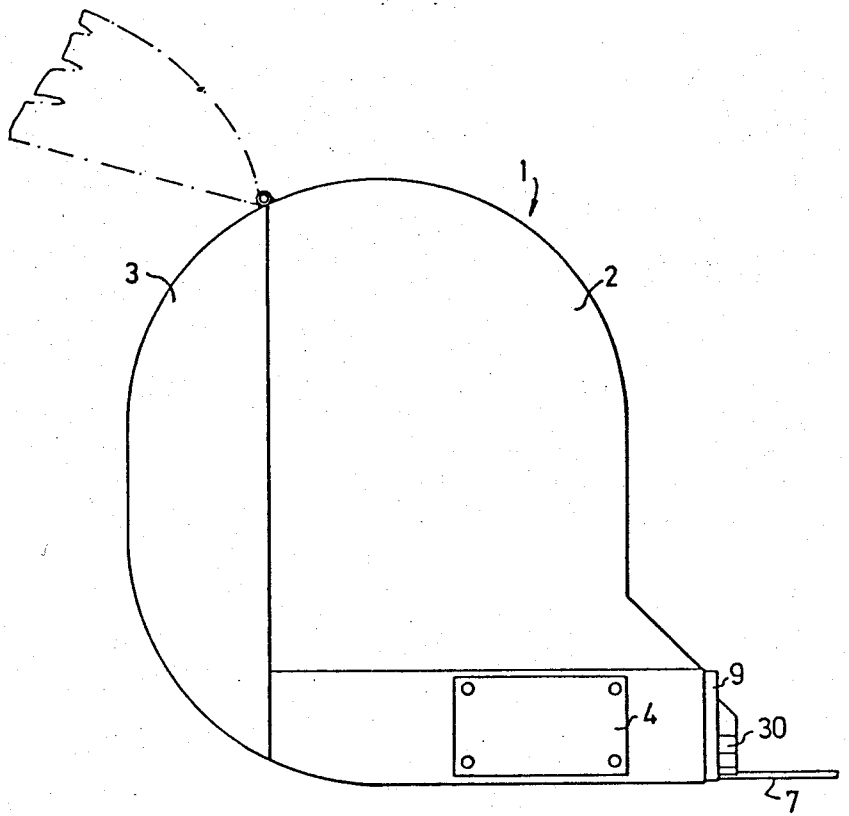
FIG. 1 is a somewhat schematic lateral view of a device according to one embodiment of the invention.
Figure 2:
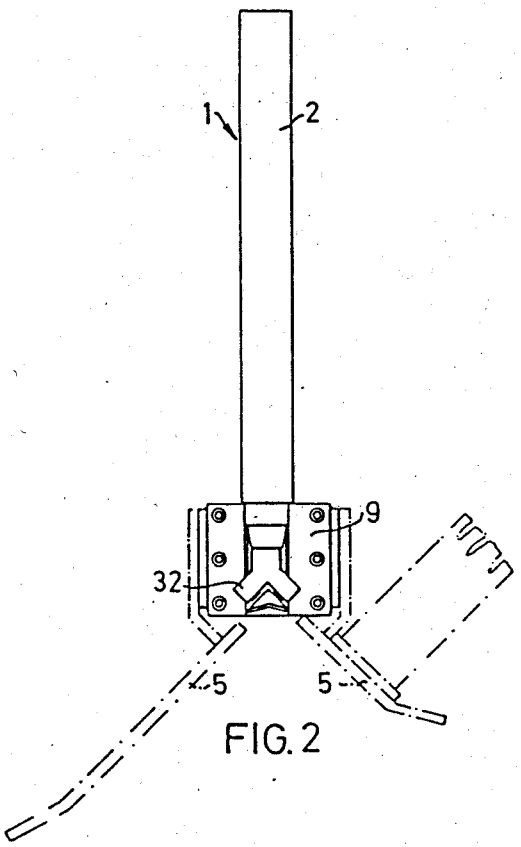
FIG. 2 is a frontal view of the device according to FIG. 1 with guide means for the device being indicated by dash-dotted lines.

The drawings illustrate a device 1 for placing edge protecting means at pressure-sensitive edges on objects, said device being contained in a housing 2 provided with an openable lid 3. There is further a removable cover 4 by means of which different parts in the device 1 can be reached for maintenance and repair. As is indicated by dash-dotted lines in FIG. 2, guide means 5 are mounted on the housing 2, said guide means 5 serving to facilitate for the device 1 to be positioned at the edge intended for the application of the edge protectng means. In order for the device 1 to be fixed in position on this edge, said device is secured to carrier means (not shown) for adjustably supporting the device and for enabling it to be placed in any predetermined position on the edge in question. The parts of the device 1 accommodated inside the housing 2 are carried by a body 6 which is only partially illustrated in the drawings.

Figure 3:
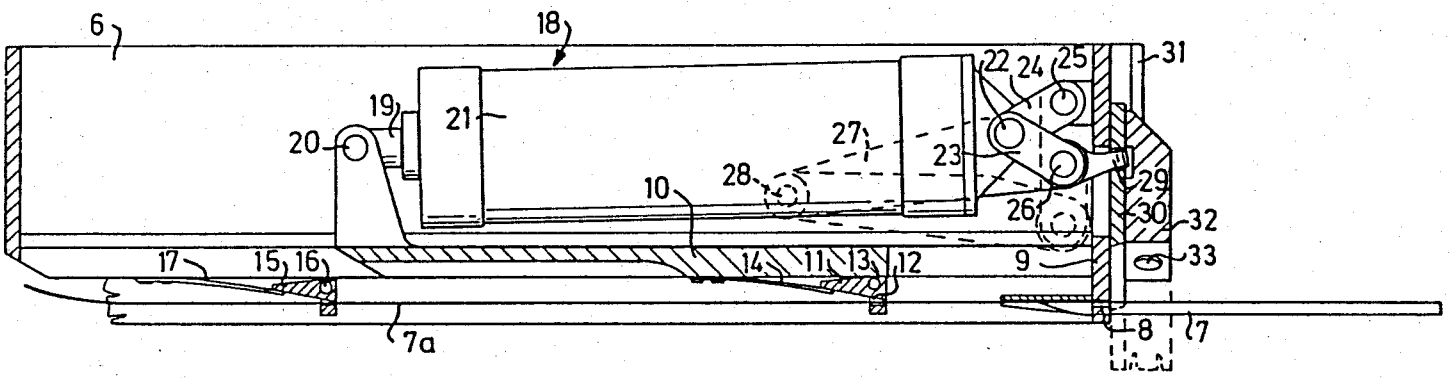
FIG. 3 is a partially cut-away lateral view of the components included in the device shown in FIGS. 1 and 2 and intended to fulfill the desired function.
Figure 4:
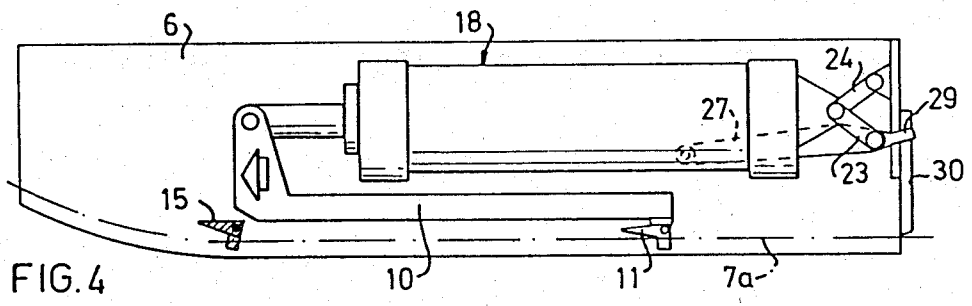
FIGS. 4 and 5 are lateral views corresponding to FIG. 3 but showing the components in alternative positions during a working cycle.
Figure 5:
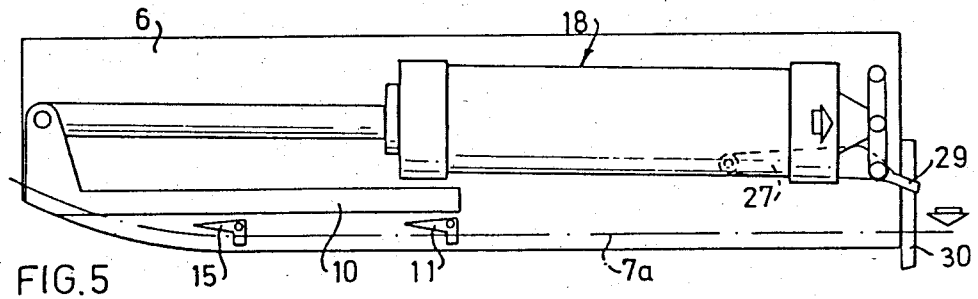

The edge protecting means 7, intended to be placed by means of the inventive method and device, consist in a known manner of angular strips to be inserted under the bundling bands used for holding together a package of objects having pressure sensitive edges such as a package of wood, for example. With the method and the device according to the invention, the edge protecting means 7 will be given their final shape only in connection with their placement at the point of application, and a large number of blanks for edge protecting means are accommodated in the housing 2 of the device 1 in the form of a continuous band wound to a magazine such as a reel, which can be introduced into the housing 2 via the lid 3. The band, which is denoted 7*a* in FIGS. 3–5, is pulled out of the reel, passed through a slot 8 in a front end wall 9 of the device, and fed out to form an edge protecting means 7. The slot 8 is angularly shaped with an obtuse angle, which means that the band 7*a* at its passage through the slot 8 is subjected to a bending moment around a longitudinal line, preferably its center line, this process constituting a preliminary bending for achieving a edge protecting means 7. In order to facilitate bending, the band 7*a* is preferably provided with a bending indication along its center line, said bending indication being obtained by grooving for example, the thickness of the band being reduced in this way by approximately one half.

The forward feed of the band 7*a* takes place with the aid of a feeding mechanism comprising a slide 10 which is reciprocally movable in the direction of feed of the band 7*a* and which carries a gripper 11. Said gripper 11 is designed with a slot 12 through which the band 7*a* extends, and is pivotable around an axis 13 disposed at right angles to the direction of feed of the band. A spring 14 is arranged to pivot the gripper 11 around the axis 13 to a position where the band 7*a* is squeezed in the slot 12, so that when the slide moves in the forward direction of feed, the band 7*a* is taken along to be fed out through the slot 8. When the slide 10 moves in the opposite direction, the gripper 11 is released from the band 7*a* in response to the action of the spring 14, whereby the band 7*a* is prevented from moving by means of a gripper 15 which is of the same type as the gripper 11 and is journalled in the body 6 by means of a shaft 16 while being spring loaded by means of a spring 17. As a result thereof the slide 10, during its reciprocating movement, will perform a stepwise advance of the band 7*a*, the stroke of the slide 10 corresponding to the predetermined length of an edge protecting means 7.

The reciprocating movement of the slide 10 is caused by an actuating device such as a pressure-medium operated piston/cylinder unit 18, the piston rod 19 of which is pivotally connected to the slide 10 via a pin 20. At the end facing away from the piston rod 19, the cylinder 21 of the piston/cylinder unit 18 is pivotally connected to two links 23 and 24 via a pin 22. The opposite end of the link 22 is pivotally connected to the body 6 via a pin 25, whereas the opposite end of the link 23 is pivotally connected to an arm 27 via a pin 26, the other end of said arm being pivotally connected to the body 6 via a pin 28. From the end of the arm 27 situated at the pin 26 there is an outwardly projecting finger 29 having its outer end extending into an opening in a knife blade 30 which is movable along the exterior of the wall 9 while being guided by a guide means 31. Furthermore, the knife blade is also provided with a retaining means 32 accompanying the movements of said knife blade 30. At its lower end the knife blade 30 has an angular cutting edge the angle of which corresponds in the main to the bending angle of the finished edge protecting means 7. The retaining means 32 as well has the same angular shape.

The function of the above-mentioned device according to the invention will be described more closely below while referring to FIGS. 3–5, illustrating various stages of forward feed, shaping and cutting of an edge protecting means 7. In the position shown in FIG. 3, the slide 10 has just been displaced to its front position while simultaneously taking along the band *7a* so far that the portion of the band extending outside the wall 9 corresponds to the length of a finished edge protecting means 7. Due to the angular shape of the slot 8, this portion has been preliminary bent to obtain the required stiffness. From this position the slide 10 thereafter moves rearwards, as shown in FIG. 4. During this movement the gripper 11 is disconnected from the band *7a*, whereas the gripper 15 retains the band to prevent it from moving backwards.

After having reached its rear position, the slide 10 will abut against the body 6. As the piston rod 19 continues to be driven out of the piston/cylinder unit 18, the cylinder 21 will move to the right, as seen in FIG. 4, into the position shown in FIG. 5. The links 23 and 24 will thereby be rotated so that the pins 25 and 26 are brought apart. As a result, the pin 26 is moved downwards, as seen in FIGS. 4 and 5, causing the knife blade 30 and the retaining means 32 to be downwardly displaced to the position shown in FIG. 5. In this way the knife blade 30 will cut off the edge protecting means 7 projecting out of the slot 8, exposing in this way said edge protecting means to an additional bending action due to the angularity of the knife blade 30. In fact, the knife blade 30 will first cut off the edges, whereupon the cutting continues all the way in towards the center, the edge protecting means 7 being progressively bent by the knife blade 30 and also by the retaining means 32. Cutting of the edge protecting means 7 is hereby coordinated with tightening of the bundling band around the package so that the edge protecting means 7, after being cut, is retained by the bundling band. It may happen sometimes, however, that this coordination does not function quite satisfactorily, and in order to prevent the edge protecting means 7 from falling off, the retaining means 32 is equipped with two resiliently suspended magnets 33 for keeping the edge protecting means 7 fixed in position.

After separation of the edge protecting means 7, the piston rod 19 is again drawn into the cylinder 21, whereby the slide 10 returns to the position shown in FIG. 3 while bringing with it the band *7a*, via the gripper 11, a distance equal to the length of the edge protecting means 7. The gripper 15 is thereby automatically disconnected and will not prevent forward feed of the band *7a*. The above-described process is then repeated for the placing of subsequent edge protecting means.

The actuation of the piston/cylinder unit 18 has not been described above, although it should be obvious to anyone skilled in the art that numerous alternatives are conceivable. The piston/cylinder unit may of course be pneumatically or hydraulically driven, and the control mechanism associated therewith could be readily designed by a person skilled in the art. Such control mechanisms do not form part of the present invention and are thus not described herein. Alternatively, the piston/cylinder unit can be replaced by any other type of setting means such as a screw-and-nut operated setting device, which would result in a similar function of the inventive arrangement. Neither the means for fixing the device 1 in its correct position for placing the edge protecting means, nor the means for coordinating the function with that of the package strapping mechanism have been described, as these components do not either form part of the present invention.

It should furthermore be observed that in certain connections, such as strapping steel products with sharp edges for example, chafing of the band against the sharp edges must be avoided, for which purpose edge protecting means are utilized. The inventive method and device are intended to cover this field of use as well.

The invention is naturally not restricted to the above-described exemplary embodiment but can be varied within the scope of the following claims.

I claim:

1. A method for placing edge protecting means at pressure-sensitive edges on objects, said method comprising the steps of: forwardly feeding in the form of a continuous band (*7a*) successive blanks for edge protecting means (7); subjecting said band (*7a*) during its forward feed to a preliminary bending around a longitudinal line; cutting off a fed-out portion of said band (*7a*) to form an edge protecting means (7) when said fed-out portion is in a correct position; and subjecting said edge protecting means (7) to a final bending simultaneously with the cutting and separation of said edge protecting means (7) in order to give said edge protecting means a shape which is adapted to an edge intended to be protected.

2. A method according to claim 1, wherein the band (*7a*) is provided with a longitudinal bending indication in order to facilitate said longitudinal bending, said indication preferably being a groove extending along the desired bending line.

3. A method according to claim 1, wherein a cutting means for said cutting is operable on the backstroke of a feeding means for said feeding, and said cutting means and said feeding means are both operable by a pressure-medium operated piston cylinder.

4. A device for placing edge protecting means at pressure-sensitive edges on objects, said device comprising: a body (6); a magazine fixed to said body and carrying a continuous band (*7a*) for successive blanks for edge protecting means; an arrangement (8–17) for feeding said band, said arrangement being also carried on said body (6), said arrangement further comprising an angular slot (8) through which said band (*7a*) is fed for achieving a preliminary bending of said band (*7a*) around a longitudinal bending line; a cutting means (30) which is also secured to said body (6) such that after said band (*7a*) is fed forward a predetermined distance, said cutting means (30) separates said fed-out portion of said band to obtain an edge protecting means (7); and a bending means (32) arranged to perform simultaneously with said separation of said band by said cutting means a final bending of said edge protecting means (7) so as to give it a shape which is adapted to an edge intended to be protected.

5. A device according to claim 4, wherein a pressure-medium operated piston cylinder unit operates both said arrangement for feeding and said cutting means such that when said arrangement for feeding is extended towards the rear of said body (6), said cutting means is simultaneously operated to separate said fed-out portion.

6. A device according to claim 4, characterized in that the feeding mechanism comprises a gripper (11) which is reciprocally movable in the direction of feed of the band, said gripper being arranged, while moving in the direction of feed, to grip the band (*7a*) and advance it a distance corresponding to the length of an edge protecting means (7), and to be released from the band (*7a*) when moving in the opposite direction.

7. A device according to claim 6, characterized in that the gripper (11) is arranged to be driven by a pressure-medium operated piston/cylinder unit (18) secured to the body (6).

8. A device according to claim 4, characterized in that the cutting means consists of a knife (30) movable across the direction of feed of the band, said knife being so designed that it also constitutes bending means for performing the final bending of the edge protecting means (7).

9. A device according to claim 8, characterized in that the knife (30) is arranged to be driven by a pressure-medium operated piston/cylinder unit (18) secured to the body (6).

* * * * *